US008390471B2

(12) United States Patent
Coates et al.

(10) Patent No.: US 8,390,471 B2
(45) Date of Patent: Mar. 5, 2013

(54) TELEMETRY APPARATUS AND METHOD FOR MONITORING A BOREHOLE

(75) Inventors: Don M Coates, Santa Fe, NM (US); M. Clark Thompson, Los Alamos, NM (US); David W. Beck, Santa Fe, NM (US)

(73) Assignee: Chevron U.S.A., Inc., San Ramon, CA (US)

( * ) Notice: Subject to any disclaimer, the term of this patent is extended or adjusted under 35 U.S.C. 154(b) by 1432 days.

(21) Appl. No.: 11/898,066

(22) Filed: Sep. 7, 2007

(65) Prior Publication Data

US 2008/0061789 A1 Mar. 13, 2008

Related U.S. Application Data

(60) Provisional application No. 60/842,936, filed on Sep. 8, 2006.

(51) Int. Cl.
*G01V 3/00* (2006.01)
*G01V 5/04* (2006.01)

(52) U.S. Cl. ..... 340/854.6; 324/333; 250/261; 250/262; 250/269.1

(58) Field of Classification Search ..... 340/853.1, 340/854.3, 854.4, 854.6, 855.4, 855.8; 367/82; 166/73; 250/261, 262, 263, 269.1; 324/333, 324/338

See application file for complete search history.

(56) References Cited

U.S. PATENT DOCUMENTS

| | | | | |
|---|---|---|---|---|
| 3,320,579 | A | | 5/1967 | Abbott |
| 3,562,741 | A | | 2/1971 | McEvoy et al. |
| 4,023,136 | A | | 5/1977 | Lamensdorf et al. .... 340/18 NC |
| 4,160,970 | A | | 7/1979 | Nicolson ..... 340/18 LD |
| 4,218,507 | A | | 8/1980 | Deffeyes et al. ..... 428/328 |
| 4,281,289 | A | | 7/1981 | Donaldson et al. |
| 4,308,499 | A | | 12/1981 | Thierbach et al. |
| 4,415,895 | A | | 11/1983 | Flagg |
| 4,430,577 | A | | 2/1984 | Bouquet ..... 307/108 |
| 4,678,893 | A | * | 7/1987 | Ruble ..... 235/70 R |
| 4,725,837 | A | * | 2/1988 | Rubin ..... 340/854.5 |
| 4,839,644 | A | | 6/1989 | Safinya et al. ..... 340/854 |
| 4,845,378 | A | * | 7/1989 | Garbe et al. ..... 307/106 |
| 4,849,699 | A | | 7/1989 | Gill et al. |

(Continued)

FOREIGN PATENT DOCUMENTS

| | | |
|---|---|---|
| DE | 10245425 A1 | 4/2003 |
| EP | 0314654 | 5/1989 |

(Continued)

OTHER PUBLICATIONS

Kepler et al.—Reflection of Microwave Pulses From Acoustic Waves: Summary of Experimental and Computational Studies—May 31, 2005—Center for Research in Scientific Computation, North Carolina State University.*

(Continued)

*Primary Examiner* — David Andrews
*Assistant Examiner* — Kyle Armstrong
(74) *Attorney, Agent, or Firm* — Pillsbury Winthrop Shaw Pittman LLP

(57) ABSTRACT

A system, method and device may be used to monitor conditions in a borehole. Energy is transmitted to a pulse generator located proximate a position to be interrogated with a sensor. The pulse generator stores the energy, then releases it in a pulse of electromagnetic energy, providing the energy to resonant circuits that incorporate the sensors. The resonant circuits modulate the electromagnetic energy and transmit the modulated energy so that it may be received and processed in order to obtain the desired measurements.

22 Claims, 10 Drawing Sheets

U.S. PATENT DOCUMENTS

| | | | | |
|---|---|---|---|---|
| 5,066,916 | A | 11/1991 | Rau | |
| 5,150,067 | A | 9/1992 | McMillan | 328/64 |
| 5,151,882 | A * | 9/1992 | Kingman | 367/82 |
| 5,302,879 | A | 4/1994 | Totty et al. | |
| 5,355,714 | A | 10/1994 | Suzuki et al. | 73/146.5 |
| 5,423,222 | A | 6/1995 | Rudd et al. | 73/779 |
| 5,451,873 | A | 9/1995 | Freedman et al. | 324/303 |
| 5,467,083 | A | 11/1995 | McDonald et al. | 340/854.6 |
| 5,546,810 | A | 8/1996 | Arikawa et al. | |
| 5,576,703 | A | 11/1996 | MacLeod et al. | 340/854.4 |
| 5,587,707 | A | 12/1996 | Dickie et al. | |
| 5,642,051 | A * | 6/1997 | Babour et al. | 324/357 |
| 5,680,029 | A | 10/1997 | Smits et al. | 320/2 |
| 5,686,779 | A | 11/1997 | Vig | 310/366 |
| 5,751,895 | A | 5/1998 | Bridges | |
| H1744 | H | 8/1998 | Clayton et al. | 374/117 |
| 5,821,129 | A | 10/1998 | Grimes et al. | 436/151 |
| 5,917,160 | A | 6/1999 | Bailey | |
| 5,936,913 | A | 8/1999 | Gill et al. | 367/25 |
| 5,942,991 | A | 8/1999 | Gaudreau et al. | 340/870.16 |
| 6,025,725 | A | 2/2000 | Gershenfeld et al. | 324/652 |
| 6,209,640 | B1 | 4/2001 | Reimers et al. | |
| 6,234,257 | B1 | 5/2001 | Ciglenec et al. | 175/50 |
| 6,393,921 | B1 | 5/2002 | Grimes et al. | 73/728 |
| 6,434,372 | B1 | 8/2002 | Neagley et al. | 455/106 |
| 6,489,772 | B1 | 12/2002 | Holladay et al. | |
| 6,633,236 | B2 | 10/2003 | Vinegar et al. | 340/854.4 |
| 6,670,880 | B1 | 12/2003 | Hall et al. | 336/132 |
| 6,766,141 | B1 | 7/2004 | Briles et al. | 455/40 |
| 6,795,373 | B1 * | 9/2004 | Aronstam | 367/85 |
| 6,993,432 | B2 | 1/2006 | Jenkins et al. | 702/13 |
| 7,017,662 | B2 | 3/2006 | Schultz et al. | 166/254.2 |
| 7,114,561 | B2 | 10/2006 | Vinegar et al. | 166/250.01 |
| 7,158,049 | B2 | 1/2007 | Hoefel et al. | 340/855.7 |
| 7,168,487 | B2 | 1/2007 | Salamitou et al. | 166/250.11 |
| 7,180,826 | B2 | 2/2007 | Kusko et al. | 367/85 |
| 7,256,707 | B2 * | 8/2007 | Clark et al. | 340/854.4 |
| 7,397,388 | B2 | 7/2008 | Huang et al. | 340/853.3 |
| 7,548,068 | B2 | 6/2009 | Rawle et al. | 324/534 |
| 2002/0157895 | A1 | 10/2002 | Dubinsky et al. | |
| 2002/0195247 | A1 | 12/2002 | Ciglenec et al. | |
| 2003/0010492 | A1 * | 1/2003 | Hill et al. | 166/65.1 |
| 2003/0053516 | A1 | 3/2003 | Atherton | |
| 2003/0102995 | A1 | 6/2003 | Stolarczyk et al. | |
| 2005/0110655 | A1 | 5/2005 | Layton | |
| 2005/0167098 | A1 * | 8/2005 | Lovell et al. | 166/248 |
| 2006/0266109 | A1 | 11/2006 | DiFoggio | |
| 2007/0030762 | A1 | 2/2007 | Huang et al. | 367/83 |
| 2007/0040557 | A1 | 2/2007 | Johnstad et al. | |
| 2007/0107528 | A1 | 5/2007 | Schroeder et al. | 73/779 |
| 2007/0206440 | A1 | 9/2007 | Fripp et al. | 367/81 |
| 2007/0235184 | A1 | 10/2007 | Thompson et al. | 166/250.01 |
| 2008/0061789 | A1 | 3/2008 | Coates et al. | 324/333 |
| 2008/0062036 | A1 | 3/2008 | Funk et al. | |
| 2008/0184787 | A1 | 8/2008 | Coates et al. | 73/152.12 |
| 2008/0185328 | A1 | 8/2008 | Stefanini | 210/222 |
| 2008/0187025 | A1 | 8/2008 | Coates et al. | 374/184 |
| 2008/0253230 | A1 | 10/2008 | Thompson et al. | 367/129 |
| 2008/0264624 | A1 | 10/2008 | Hall et al. | 166/66.5 |
| 2008/0285619 | A1 | 11/2008 | Thompson et al. | |
| 2009/0031796 | A1 | 2/2009 | Coates et al. | |
| 2009/0159361 | A1 | 6/2009 | Coates et al. | 181/106 |
| 2009/0174409 | A1 | 7/2009 | Coates et al. | 324/338 |

FOREIGN PATENT DOCUMENTS

| | | | |
|---|---|---|---|
| EP | 0314654 | A1 | 5/1989 |
| EP | 1434063 | A | 6/2004 |
| GB | 0320804.8 | * | 9/2003 |
| GB | 2386691 | | 9/2003 |
| GB | 2425593 | | 11/2006 |
| WO | 01/73380 | A1 | 10/2001 |
| WO | 01/75410 | A1 | 10/2001 |
| WO | 02/93126 | A2 | 11/2002 |
| WO | 2004/003329 | A2 | 1/2004 |
| WO | 2004003329 | A2 | 1/2004 |

OTHER PUBLICATIONS

Goswami et al., On Subsurface Wireless Data Acquisition System, IEEE Transactions on Geoscience and Remote Sensing, vol. 43, No. 10, Oct. 2005.

International Search Report and Written Opinion for PCT International Patent Application No. PCT/US2008/075214, mailed on Oct. 10, 2009.

International Search Report and Written Opinion for PCT International Patent Application No. PCT/US2010/057414, mailed on Feb. 22, 2011.

International Search Report for PCT/US2007/077866, issued on Mar. 30, 2009.

Written Opinion for PCT/US2007/077866, issued on Mar. 30, 2009.

Australian Examiner's Report in Australian Patent Application No. 2007292254, mailed on Apr. 24, 2012.

Chinese Office Action received in Chinese Patent Application No. 200780039280.5, mailed Jun. 22, 2011.

* cited by examiner

TELEMETRY APPARATUS AND METHOD FOR MONITORING A BOREHOLE

RELATED APPLICATION

This application claims priority to U.S. Provisional Patent Application No. 60/842,936, filed Sep. 8, 2006, which is incorporated herein by reference in its entirety.

BACKGROUND

1. Field

The present invention relates generally to remote sensing and more particularly to passively communicating remote conditions by modulated reflectivity.

2. Background

In resource recovery, it may be useful to monitor various conditions at locations remote from an observer. In particular, it may be useful to provide for monitoring conditions at or near to the bottom of a borehole that has been drilled either for exploratory or production purposes. Because such boreholes may extend several miles, it is not always practical to provide wired communications systems for such monitoring.

U.S. Pat. No. 6,766,141 (Briles et al) discloses a system for remote down-hole well telemetry. The telemetry communication is used for oil well monitoring and recording instruments located in a vicinity of a bottom of a gas or oil recovery pipe. Modulated reflectance is described for monitoring down-hole conditions.

As described in U.S. Pat. No. 6,766,141, a radio frequency (RF) generator/receiver base station communicates electrically with the pipe. The RF frequency is described as an electromagnetic radiation between 3 Hz and 30 GHz. A down-hole electronics module having a reflecting antenna receives a radiated carrier signal from the RF generator/receiver. An antenna on the electronics module can have a parabolic or other focusing shape. The radiated carrier signal is then reflected in a modulated manner, the modulation being responsive to measurements performed by the electronics module. The reflected, modulated signal is transmitted by the pipe to the surface of the well where it can be detected by the RF generator/receiver.

SUMMARY

An aspect of an embodiment of the present invention includes an apparatus for sensing a characteristic of a borehole. The apparatus includes a transmission line, constructed and arranged to transmit an electromagnetic signal within the borehole, and a probe, positionable at a location within the borehole at which the borehole characteristic is to be sensed, and at which energy propagated via the transmission line may be received. The probe includes an energy storing circuit element, configured to receive and store energy transmitted through the transmission line, a pulse generator, configured to receive stored energy from the energy storing circuit element and to discharge the energy to generate a pulse of electromagnetic energy, a resonant circuit portion that is configured and arranged to receive energy from the pulse of electromagnetic energy and produce a modulated electromagnetic signal representative of the borehole characteristic, and a coupler, configured to couple the modulated electromagnetic signal to the transmission line and to transmit a signal representative of the modulated electromagnetic signal via the transmission line.

An aspect of an embodiment of the present invention includes an apparatus for sensing a characteristic of a borehole, that is positionable at a location within the borehole at which the borehole characteristic is to be sensed, and at which electromagnetic energy propagated along the borehole may be received. The apparatus includes an energy storing circuit element, configured to receive and store the electromagnetic energy, a pulse generator, configured to receive stored energy from the energy storing circuit element and to discharge the energy to generate a pulse of electromagnetic energy, a resonant circuit portion that is configured and arranged to receive energy from the pulse of electromagnetic energy and produce for analysis a modulated electromagnetic signal representative of the borehole characteristic.

An aspect of an embodiment of the present invention includes a method for sensing a characteristic of a borehole, that includes receiving electromagnetic energy proximate a location within the borehole at which the borehole characteristic is to be sensed, storing the received electromagnetic energy, then discharging the stored energy to generate an electromagnetic pulse within the borehole, receiving energy from the electromagnetic pulse in a resonant circuit to produce an electrical signal in the resonant circuit, modulating the electrical signal to produce a modulated electromagnetic signal representative of the borehole characteristic, and transmitting the modulated electromagnetic signal for analysis.

An aspect of an embodiment of the present invention includes a system for monitoring a characteristic of a borehole, including a transmitter configured and arranged to transmit an electromagnetic signal into the borehole, a transmission line constructed and arranged to guide propagation of the electromagnetic signal within the borehole, a probe, positionable at a location within the borehole at which the borehole characteristic is to be sensed, and at which energy propagated via the transmission line may be received, the probe portion including an energy storing circuit element, configured to receive and store energy transmitted through the transmission line, a spark generator, configured to receive stored energy from the energy storing circuit element and having electrodes separated by a gap, the spark generator being further configured and arranged such that when a voltage across the gap exceeds a breakdown voltage of a medium in which the probe is located, a spark discharge between the electrodes generates an electromagnetic pulse, a resonant circuit portion that is configured and arranged to receive energy from the electromagnetic pulse and produce a modulated electromagnetic signal representative of the borehole characteristic, a coupler portion, configured to receive the modulated electrical signal and to transmit a radio frequency signal representative of the modulated electromagnetic signal via the transmission line, a receiver, configured and arranged to receive the radio frequency signal representative of the modulated electrical signal and to output an electrical signal representative of the received radio frequency signal, and a processor, configured and arranged to accept as an input the electrical signal output by the receiver and to process the received electrical signal to determine information relating to the monitored characteristic.

DESCRIPTION OF THE DRAWINGS

Other features described herein will be more readily apparent to those skilled in the art when reading the following detailed description in connection with the accompanying drawings, wherein.

DETAILED DESCRIPTION

Figure 1A:
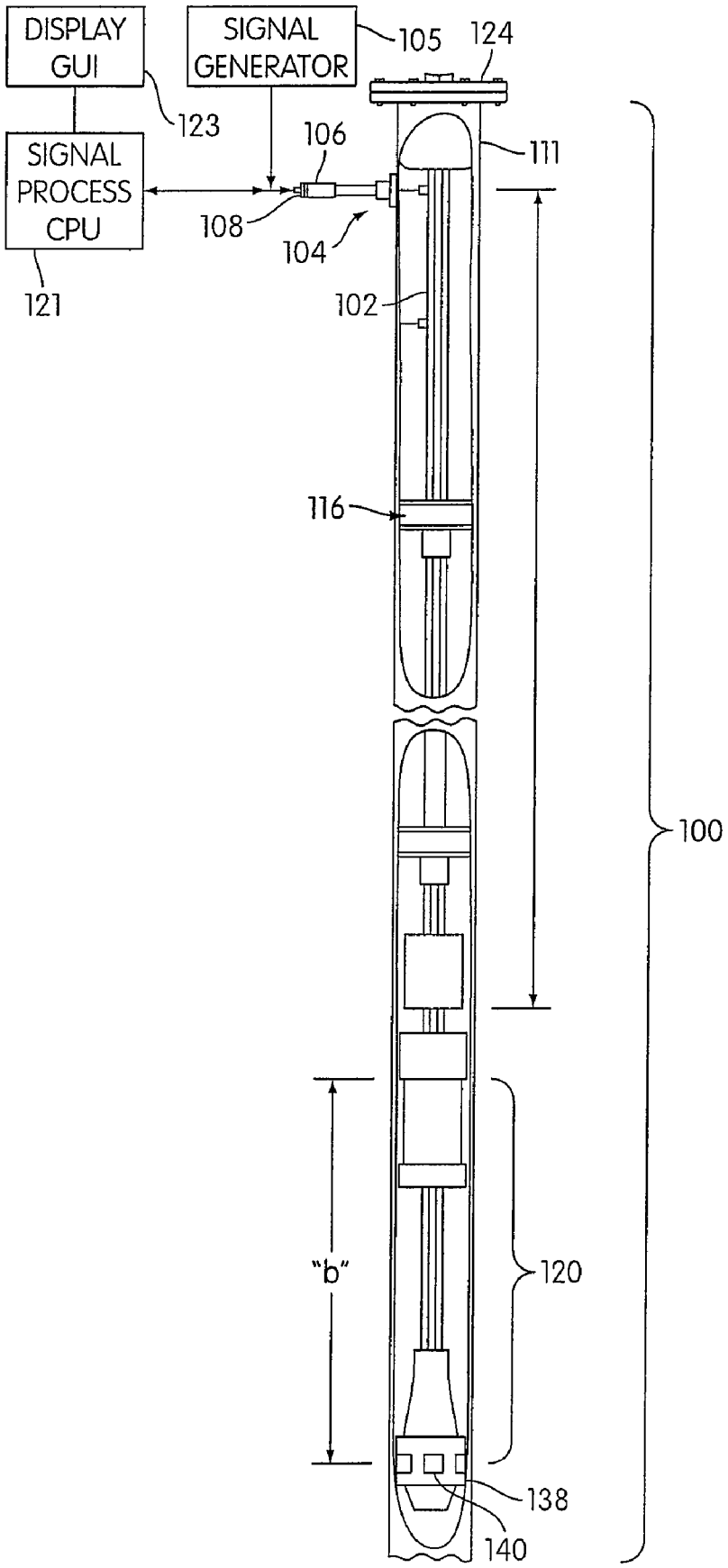
FIGS. 1A-1D show an embodiment of an apparatus for sensing a characteristic of a borehole.

FIG. 1 illustrates an example of an apparatus 100 for sensing a characteristic of a borehole. The borehole can be any cavity, configured with any orientation, having a characteristic such as a material composition, temperature, pressure, flow rate, or other characteristic, which can vary along a length of the borehole.

The apparatus 100 includes an electromagnetically transmissive medium, such as a conductive pipe 102, for conducting electromagnetic energy through the borehole. An input 104, coupled (e.g., connected) to the conductive pipe 102, is provided for applying electromagnetic energy to the conductive pipe. In embodiments, the electromagnetic energy can be of any desired frequency selected, for example, as a function of characteristics to be measured within the borehole and as a function of the length and size of the borehole.

The inlet includes a connector 106 coupled with the conductive pipe 102. The connector 106 can be formed, for example, as a coaxial connector having a first (e.g., interior) conductor coupled electrically to the conductive pipe 102, and having a second (e.g., exterior) conductive casing coupled to a hollow borehole casing 111. An insulator, for example, a PTFE or nylon material, may be used to separate the interior conductor from the exterior conductive casing.

The inlet can include an inductive isolator, such as a ferrite inductor 108 or other inductor or component, for electrically isolating the inlet from a first potential (e.g., a potential, such as a common ground, of the return current path of the borehole casing 111) at a location in a vicinity of the input 104. The apparatus 100 can include a source of electromagnetic energy, such as a signal generator 105, coupled to the inlet for generating the electromagnetic energy to be applied to the conductive pipe or other type of transmission line. The signal generator 105 may be configured to produce a pulsed or a continuous wave signal, as necessary or desirable.

The hollow borehole casing 111 can be placed into the borehole whose characteristics are to be monitored. The hollow borehole casing 111 can, for example, be configured of steel or other suitable material. In a typical drilling application, the borehole casing 111 may be a standard casing used to provide structural support to the borehole in ordinary drilling applications and it is not necessary to provide any additional outer conductive medium.

The conductive pipe 102 can be located within, and electrically isolated from, the hollow borehole casing using spacers 116. The spacers can, for example, be configured as insulated centralizers which maintain a separation distance of the conductive pipe 102 from the inner walls of the hollow borehole casing 111. These insulating spacers can be configured as disks formed from any suitable material including, but not limited to nylon or PTFE. As will be appreciated, the conductive pipe 102 in conjunction with the casing 111 together form a coaxial transmission line. Likewise, it is contemplated that alternate embodiments of a transmission line may be employed, such as a single conductive line, paired conductive lines, or a waveguide. For example, the casing alone may act as a waveguide for certain frequencies of electromagnetic waves. Furthermore, lengths of coaxial cable may be used in all or part of the line. Such coaxial cable may be particularly useful when dielectric fluid cannot be used within the casing 111 (e.g., when saline water or other conductive fluid is present in the casing 111).

Figure 5:
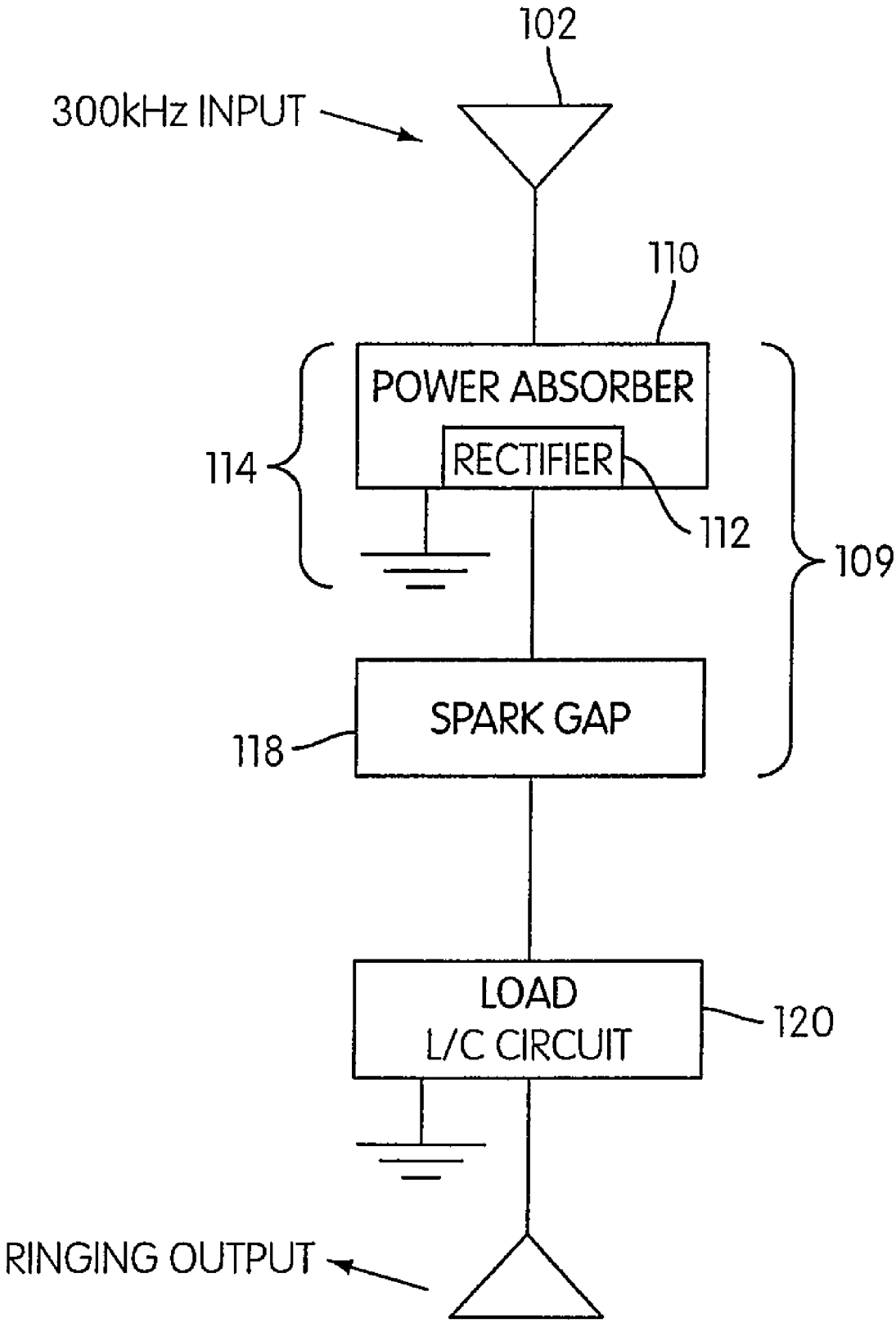
FIG. 5 shows an embodiment of a circuit for detecting a characteristic.

The apparatus 100 includes a pulse generator 109, for generating an electrical pulse to be transmitted through the conductive pipe 102. Alternatively, the pulse generator can generate an electromagnetic pulse that is transmitted through the ground to an above ground antenna. The pulse generator may be attached to or otherwise magnetically coupled to the conductive pipe 102. The pulse generator 109 may be any device including, but not limited to, an electronic structure for receiving electromagnetic energy and generating a resonant signal therefrom. An exemplary embodiment of the pulse generator 109 is schematically illustrated in FIG. 5 and more particularly illustrated in FIG. 7. As shown in FIG. 2B, the pulse generator 109 may be stacked along with the resonant network devices 120 described below.

As schematically illustrated in FIG. 5, the pulse generator 109 may include a component such as a power absorber 110, for storing the electromagnetic energy transmitted through the conductive pipe 102. The power absorber 110 stores the electrical pulse in capacitors, batteries or other electrical energy storage devices.

The power absorber 110 also may include a converter, such as a rectifier 112, for converting the electrical pulse into constant power or direct current energy. The rectifier 112 provides the direct current energy on its output to the electrical energy storage device 114.

The pulse generator 109 may also include a pulse generator such as a spark gap 118 for generating an electromagnetic pulse using the energy stored in the electrical energy storage device 114. Those of ordinary skill in the art will appreciate that the spark gap 118 may be formed between two electrodes that are housed in a glass enclosure, which may be filled with an inert gas. As the energy stored in the electrical storage device 114 increases, the breakdown potential of the spark gap also increases when the breakdown potential reaches its limit an arc of energy is generated across the spark gap 118. In the case that the electrodes are partially consumed by the process of spark generation, it may be useful to include a feed mechanism that feeds additional electrode material into the spark generation region. For example, lengths of conductive wire may serve as the electrodes and may be continuously or intermittently fed into the enclosure in order to replenish the electrodes over time.

The pulse generator 109 includes reactive components, such as a resonant network device 120 responsive to the pulse of the spark gap 118, for resonating at a frequency which is modulated as a function of a characteristic of the borehole. The resonant circuit 118 may include a resonator L/C circuit composed of inductive and capacitive elements that are configured and arranged to produce a ringing output. The resonant network device 120 can be, for example, any electroacoustic or other device including, but not limited to any magnetically coupled electrically resonant mechanical structure for performing an electrical resonance, such as the resonant cavity of FIG. 2A, the tank circuit of FIG. 2B, or any other suitable device. The resonant network device 120 can be connected with or mechanically coupled to the conductive pipe 102. In an embodiment, the resonant network device 120 may include an inductor formed with a toroidal core and magnetically coupled to the conductive pipe 102. The toroidal core is a magnetic core formed as a medium by which a magnetic field can be contained and/or enhanced. For example, the resonant network device 120 can be a single turn coil with a one inch cross-section wrapped around a ferrite core, or any other suitable device of any suitable shape, size and configuration can be used.

The ringing signal generated by the resonant network device includes information of interest because it is modulated by changes in either the capacitor, inductor or both, which thus act as the sensors. For example, the frequency of the ringing is determined by the shifts in the L/C circuit's value of capacitance and/or inductance. Note this frequency is chosen so as not to be at the same frequency of the input charging frequency (which is typically 300 kHz) so as to not confuse data interpretation. By way of example, the capacitor of the L/C circuit may be configured as a capacitive pressure sensor, in which distance between plates of the capacitor is reduced as pressure is increased, and vice versa. Likewise, inductive displacement sensors may be used, where inductance changes with motion of a permeable core in accordance with changes in pressure in a volume, or strains in a structure.

The intensity of the signal's energy is such that much energy can be transmitted through the ground itself. The interaction of the signal with the surrounding formation can yield important information about the formation itself. Indeed, the signal can be received by separate above ground surface antennas away from the well site and the signal interpreted by various methods. Shifts in the signal's frequency, attenuation, delays and echo effects may give valuable underground information.

Those skilled in the art will appreciate that a magnetic core is a material significantly affected by a magnetic field in its region, due to the orientable dipoles within its molecular structure. Such a material can confine and/or intensify an applied magnetic field due to its low magnetic reluctance. The wellhead ferrite inductance 108 can provide a compact inductive impedance in a range of, for example, 90-110 ohms reactive between an inlet feed point on the pipe and a wellhead flange short. This impedance, in parallel with an exemplary 47 ohm characteristic impedance of the pipe-casing transmission line can reduce the transmitted and received signals by, for example, about ~3 dbV at the inlet feed point for a typical band center at 50 MHz. The magnetic permeability of the ferrite cores can range from ~20 to slightly over 100, or lesser or greater. As such, for a given inductance of an air-core inductor, when the core material is inserted, the natural inductance can be multiplied by about these same factors. Selected core materials can be used for the frequency range of, for example, 10-100 MHz, or lesser or greater.

The resonant network device 120 receives energy from the spark gap 118, and "rings" at its natural frequency. A sensor can include a transducer provided in operative communication with the resonant network device 120, and coupled (e.g., capacitively or magnetically coupled) with a known potential (e.g., a common ground). The transducer may be configured to sense a characteristic associated with the borehole, and to modulate the vibration frequency induced in the resonant network device 120 when electromagnetic energy is transmitted through the conductive pipe 102 and an energy pulse is received from the spark gap 118. The modulated vibration frequency can be processed to provide a measure of the borehole characteristic. That is, the vibration frequency induced by the pulse is modulated by a sensed characteristic of the borehole, and this modulation of the vibration can be processed to provide a measure of the characteristic.

A sensor can include, or be associated with, a processor (e.g., the CPU or the CPU and associated electronics of computer 121). The processor 121 can provide a signal representing the characteristic to be measured or monitored.

The processor 121 can be programmed to process the modulated vibration frequency to provide a measure of the sensed characteristic. The measurement can, for example, be displayed to a user via a graphical user interface (GUI) 123. The processor 121 can perform any desired processing of the detected signal including, but not limited to, a statistical (e.g., Fourier) analysis of the modulated vibration frequency, a deconvolution of the signal, a correlation with another signal or the like. Commercial products are readily available and known to those skilled in the art can be to perform any suitable frequency detection. For example, a fast Fourier transform that can be implemented by, for example, MATHCAD available from Mathsoft Engineering & Education, Inc. or other suitable product to deconvolve the modulated ring received from the resonant network device. The processor can be used in conjunction with a look-up table having a correlation table of modulation frequency-to sensed characteristics (e.g., temperature, pressure, and so forth) conversions.

In an embodiment, at least a portion of the hollow borehole casing 111 is at a first potential (e.g., common ground). For example, the hollow borehole casing can be at a common ground potential at both a location in a vicinity of the inlet 104, and at a location in a vicinity of the pulse generator 109. The grounding of the hollow borehole casing in a vicinity of the inlet is optional, and may help to establish a known impedance for the conductive pipe. The grounding of the hollow borehole casing in a vicinity of the pulse generator 109 may allow the resonant length to be defined. That is, the resonant cavity has a length within the hollow borehole casing defined by the distance between toroidal coil 112 and by the ground connection at a second, lower end of the resonant cavity.

The transducer of the resonant network device 120 of the pulse generator 109 can be configured to include passive electrical components, such as inductors and/or capacitors, such that no down-hole power is needed. Alternately, power may be stored in batteries or capacitors for use in powering active components. During an assembly of the FIG. 1 apparatus 100, the conductive pipe can be assembled in sections, and a spacer can be included at each joint between the various pipe sections to ensure stability. Prior to placing the conductive pipe 102 and the pulse generator 109 into a borehole, a transducer used for sensing the modulated vibration frequency can be calibrated using the GUI 123 and processor 121.

Details of the embodiment illustrated in FIG. 1A will be described further with respect to FIG. 1B, which shows an example of a telemetry component of the apparatus.

Figure 1B:
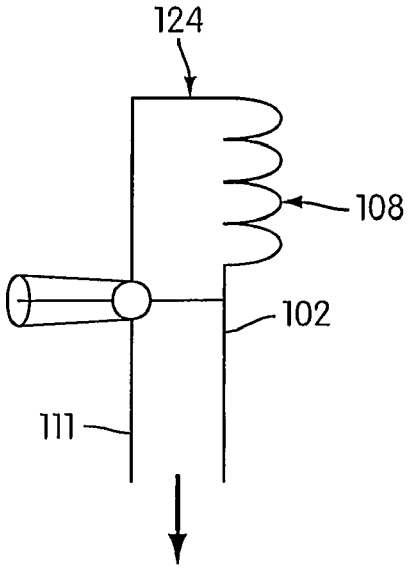

As shown in FIG. 1B, the conductive pipe 102 and hollow borehole casing 111 are electrically isolated from one another via the ferrite inductance 108. Where the resonant network device is a natural resonator, the wavelength of the resonant "ring" frequency can dictate the size (e.g., length) of the device. Those skilled in the art will appreciate that the size constraint can be influenced (e.g., reduced) by "loading" the device with inductance and/or capacitance. For example, the amount of ferrite used in an particular implementation can be selected as a function of desired frequency and size considerations.

An instrumentation signal port 112 may be provided for receiving the probe 106. A wellhead configuration, a depicted in FIG. 1B, is short circuited to the hollow borehole casing.

The ferrite inductor 108 thus isolates the conductive probe of the inlet, which is coupled with the conductive pipe 102, from the top of the wellhead which, in an embodiment, is at a common ground potential. In an exemplary embodiment, because the wellhead is grounded via short circuiting of the wellhead flange 124 to common ground, the ferrite inductor isolates the short circuited wellhead flange from the conductive pipe used to convey a pulse from the probe to the resonant cavity.

As noted above, the conductive pipe 102, along with the casing 111, form a coaxial line that serves as a transmission line for communication of the down-hole electronics, such as the transducer, with the surface electronics, such as the processor.

Figure 1C:
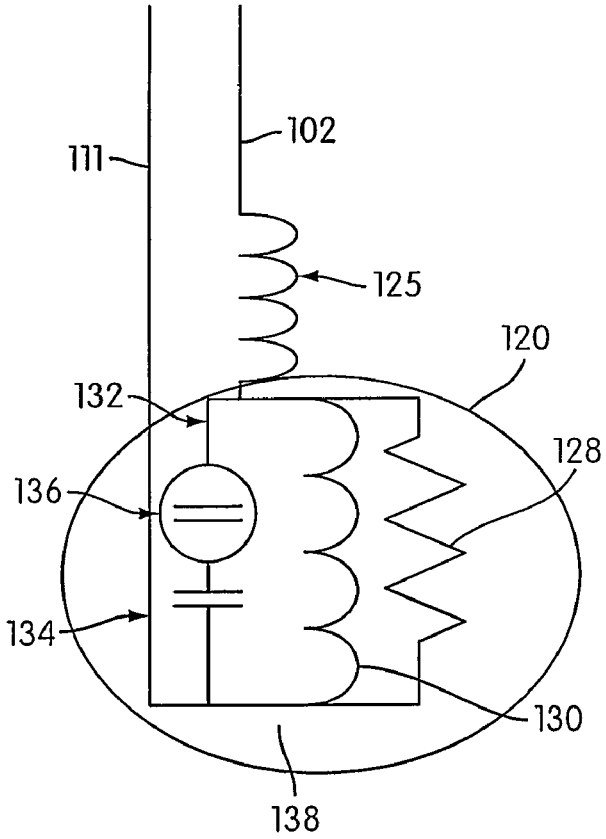

FIG. 1C illustrates an electrical representation of the resonant cavity and transducer included therein. In FIG. 1C, the toroidal core 125 is represented as an inductor section configured of ferrite material for connecting the conductive pipe 102 with the resonant cavity 120. As can be seen in FIG. 1C, for a resonant network device configured as a resonant cavity, an upper portion 132 of the resonant cavity 120 coincides with a lower section of the toroidal core 125 and can be at an impedance which, in an exemplary embodiment, is relatively high as compared to the impedance between conductive pipe 102 and the casing 111. For example, the impedance at the top of the resonant cavity can be on the order of 2000 ohms, or lesser or greater. For magnetic core based, magnetically coupled resonant networks, those measures may have little or no relevance.

This relatively large differential impedance at the top of the resonant cavity relative to the conductive pipe above the resonant cavity provides, at least in part, an ability of the cavity to resonate, or "ring" in response to the pulse and thereby provide a high degree of sensitivity in measuring a characteristic of interest. In addition, the ability of the transducer to provide a relatively high degree of sensitivity is aided by the placing a lower end of the resonant cavity at the common ground potential.

The FIG. 1C electrical representation of the resonant network device, for a coaxial cavity formed by the conductive pipe and the borehole casing, includes a representation of the resonant network resistance 128 and the resonant network inductance 130. A lower portion of the cavity defined by the common ground connection 114 is illustrated in FIG. 1C, such that the cavity is defined by the bottom of the toroidal core 112 and the ground connection 114. A capacitance of the sleeve associated with the resonant cavity is represented as a sleeve capacitance 134.

The transducer associated with the resonant cavity for modulating the vibration frequency induced by the pulse, as acted upon by the characteristic to be measured, is represented as a transducer 136.

For a resonant cavity configuration, the bottom of the resonant capacity can include a packer seal, to prevent the conductive pipe 102 from touching the hollow borehole casing 111. The packer 138, as illustrated in FIG. 1C and in FIG. 1A, may include exposed conductors 140 which can interface with conductive portions of the resonant cavity and the hollow borehole casing 111 to achieve the common ground connection 114 at a lower end of the resonant cavity.

Figure 1D:
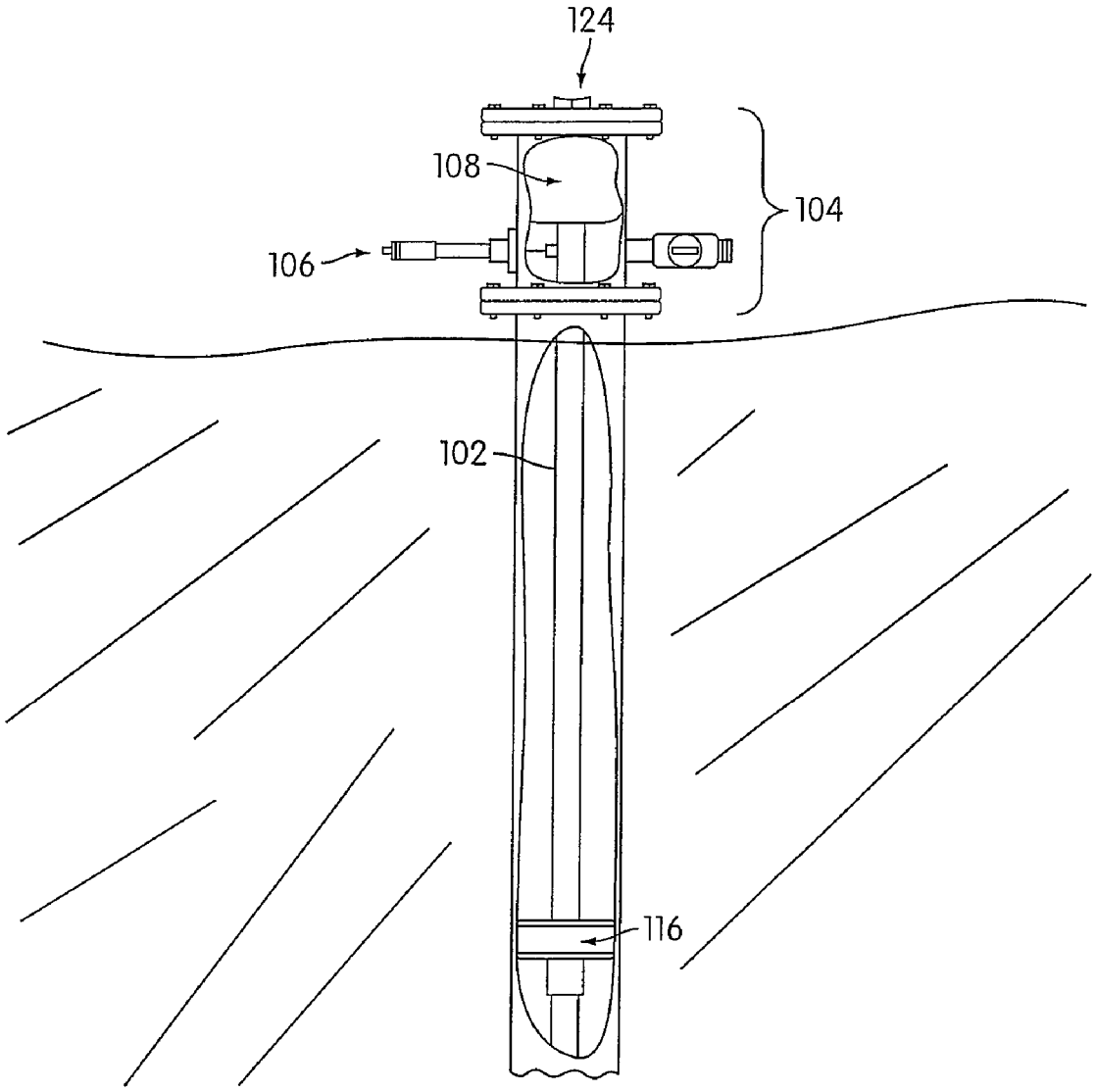

FIG. 1D illustrates another detail of the well telemetry component included at an upper end of the conductive pipe 102. In FIG. 1D, a connection of the probe 106 to the conductive pipe 102 is illustrated as passing through the hollow borehole casing 111, in the inlet 104. FIG. 1D shows that the probe 106 is isolated from the short circuited wellhead flange 124 via the ferrite inductor 108.

Figure 2A:
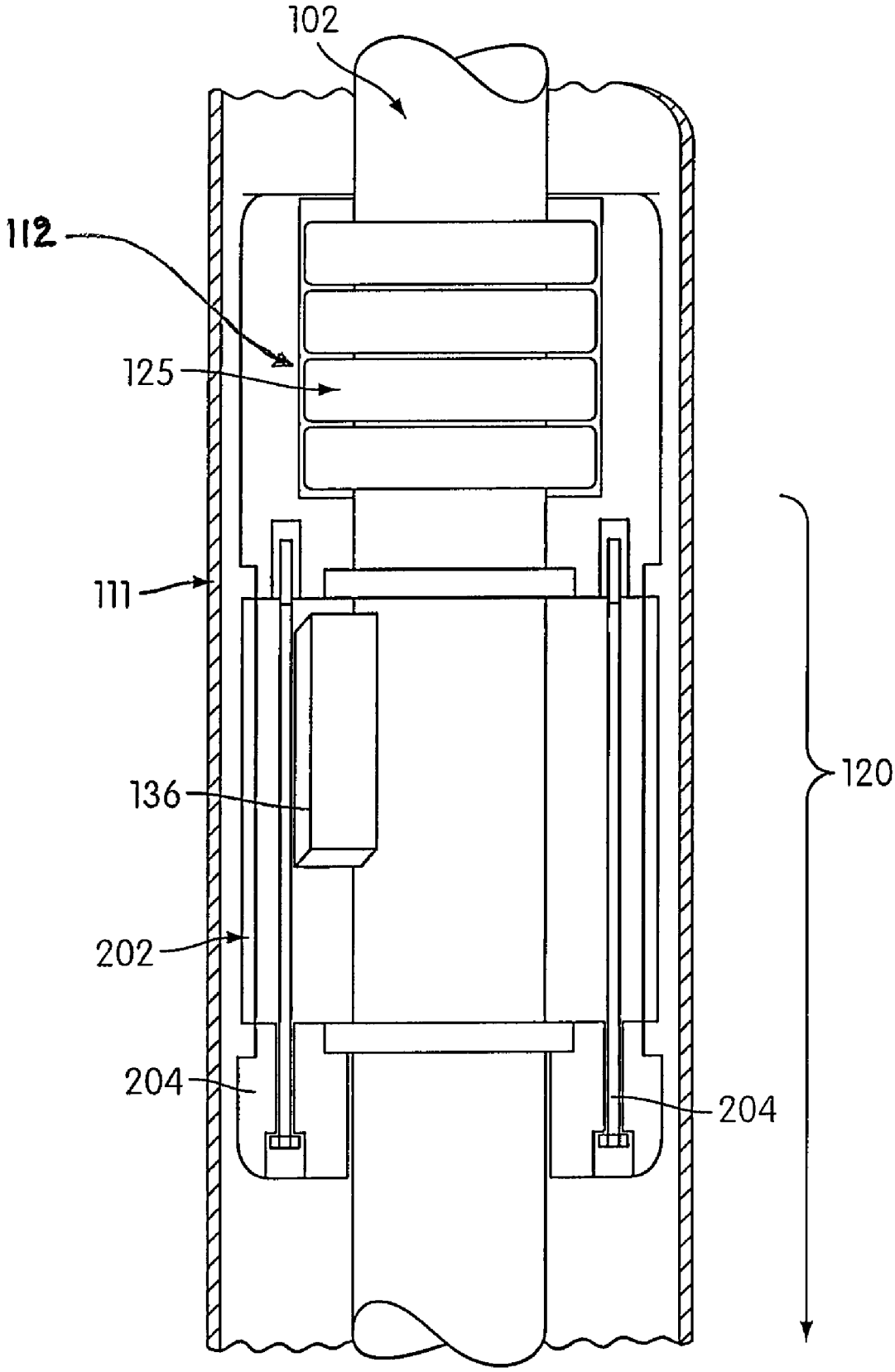
FIG. 2A shows an embodiment of a resonant cavity for use in an embodiment of the apparatus illustrated in FIG. 1.
Figure 2B:
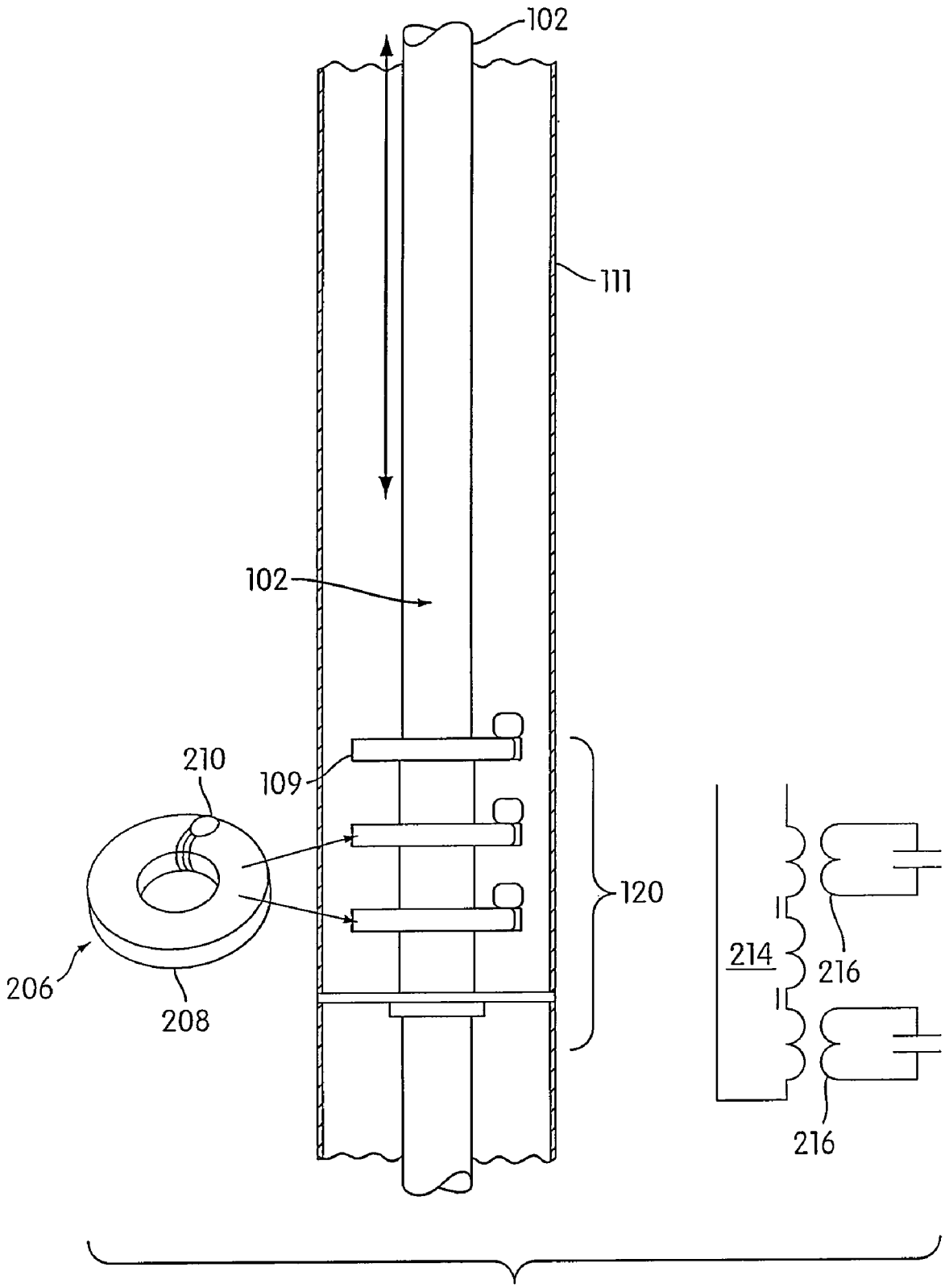
FIG. 2B shows an example of a resonant network device formed as a magnetically coupled electrically resonant mechanical structure for performing electrical resonance.

FIG. 2A shows an example of a detail of a resonant network device 120 formed as a resonant cavity. In FIG. 2A, the hollow borehole casing 111 can be seen to house the conductive pipe 102. The toroidal core 112 is illustrated, a bottom of which, in the direction going downward into the borehole, constitutes an upper end of the resonant cavity. The transducer 136 is illustrated as being located within a portion of the resonant cavity, and is associated with a conductive sensor sleeve 202, the capacitance of which is represented in FIG. 1C as the sleeve capacitance 134.

The ferrite toroidal core 112 can be configured as toroidal core slipped into a plastic end piece. Such ferrite materials are readily available, such as cores available from Fair-Rite Incorporated, configured as a low μ, radio frequency type material, or any other suitable material. Mounting screws 204 are illustrated, and can be used to maintain the sensor sleeve and transducer in place at a location along a length of the conductive pipe 102. A bottom of the resonant cavity, which coincides with a common ground connection of the packer to the hollow borehole casing, is not shown in FIG. 2.

FIG. 2B illustrates an exemplary detail of a resonant network 120 formed as a tank circuit. In FIG. 2B, multiple resonant network devices 206 associated with multiple sensor packages can be included at or near the packer. In the FIG. 2B embodiment, resonators using capacitive sensors and ferrite coupling transformers are provided. Again, the hollow borehole 111 can be seen to house the conductive pipe 102. Each resonant network device may be configured as a toroidal core 208 having an associated coil resonator 210. No significant impedance matching, or pipe-casing shorting modifications, to an existing well string need be implemented. The coaxial string structure can carry current directly to a short at the packer using the ferrite toroid resonators as illustrated in FIG. 2B, without a matching section as with the resonant cavity configuration.

In an electrical schematic representation, the conductive pipe can be effectively represented as a single turn winding 214 in the transformer construct, and several secondary windings 216 can be stacked on the single primary current path. The quality of the packer short is of little or no significance. Metal-toothed packers can alternatively be used. The return signal using this transformer method can be detected, without using a low packer shorting impedance.

In the embodiment of FIG. 2B, spacing between multiple resonant network devices 206 can be selected as a function of the desired application. The resonant network devices 206 can be separated sufficiently to mitigate or eliminate mechanical constraints. In addition, separation can be selected to mitigate or eliminate coupling between the devices 206.

In an embodiment, a distance of one width of a ring can decrease coupling for typical applications. The inductance and/or capacitance of each resonant network device can be modified by adding coil turns, and the number of turns can be selected as a function of the application. For example, the number of turns will, in part, set a ring frequency of each resonant network device. Particular embodiments can be on the order of 3 to 30 turns, or lesser or greater.

In particular embodiments, the frequency used for the resonant network devices can be on the order of 3 MHz to 100 MHz or lesser or greater, as desired. The frequency can be selected as a function of the material characteristics of the conductive pipe (e.g., steel). Skin depth can limit use of high frequencies above a certain point, and a lower end of the available frequency range can be selected as a function of the simplification of the resonant network device construction.

However, if too low a frequency is selected, decoupling from the wellhead connection short should be considered.

Thus, use of ferrite magnetic materials can simplify the downhole resonant network devices mechanically, and can allow less alterations to conventional well components. Use of a ferrite magnetic toroid can permit magnetic material to enhance the magnetic field, and thus the inductance, in the current path in very localized compact regions. Thus, stacking of multiple resonant network devices at a remote site down the borehole can be achieved with minimal interaction among the multiple devices. The multiple sensor devices can be included to sense multiple characteristics. The use of a ferrite magnetic toroid can also be used to achieve relatively short isolation distances at the wellhead connection for coupling signal cables to the conductive pipe 102 as shown in FIG. 2C.

Figure 2C:
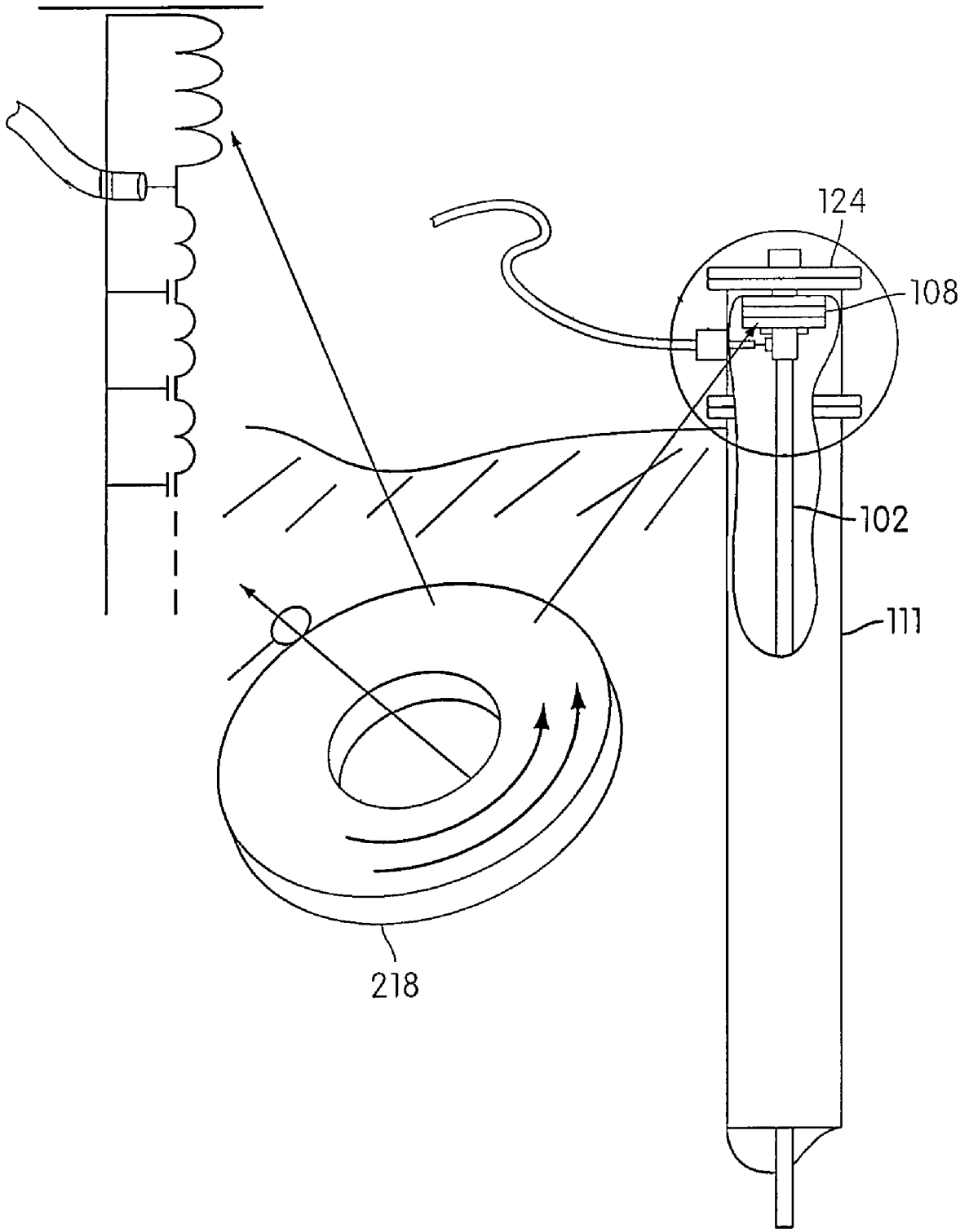
FIG. 2C illustrates an alternate example of a wellhead connection.

FIG. 2C illustrates an embodiment of a wellhead connection, wherein a spool 218 is provided to accommodate the ferrite isolator and signal connections. A spool can, for example, be on the order of 8 to 12 inches tall, or any other suitable size to accommodate the specific application. The spool is used for signal connection to the pipe string.

The resonant network device configured of a "toroidal spool" can be separated and operated substantially independently of sensor packages which are similarly configured and placed in a vicinity of the spool 218. An increased inductance in a width of the toroid spool can be used to isolate the signal feed point at the wellhead connection. As is represented in FIG. 2C, current on the pipe surface will induce magnetic fields within the ferrite toroid for inductive enhancement of the pipe current path.

Figure 3:
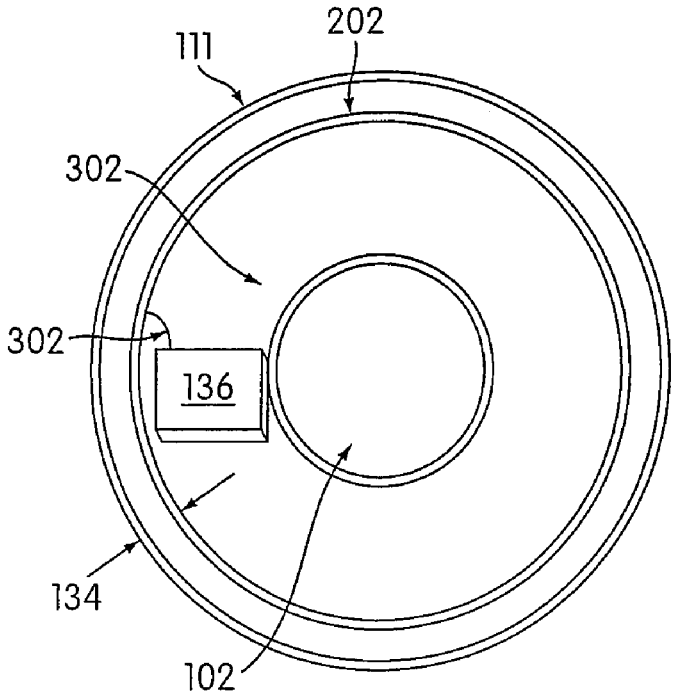
FIG. 3 shows a bottom view of an embodiment of a resonant cavity.

FIG. 3 illustrates a view of the FIGS. 2A and 2B devices from a bottom of the borehole looking upward in FIG. 2. In FIG. 3, the transducer 136 can be seen to be connected via, for example, electrical wires 302 to both the sensor sleeve 202 and the conductive pipe 102. The sensor sleeve in turn, is capacitively coupled to the hollow borehole casing 111 via the sleeve capacitance 134.

Figure 4:
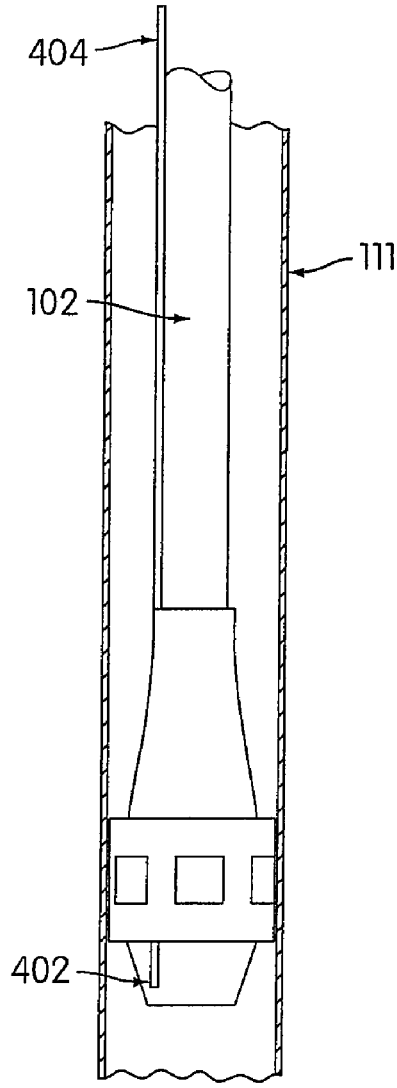
FIG. 4 shows an alternate embodiment of a resonant cavity.

FIG. 4 illustrates an embodiment wherein the packer has been modified to include a conduit extension 402 into a zone of interest where the characteristic of the borehole is to be measured. This extension 402 can, in an exemplary embodiment, be a direct port for sensing, for example, a pressure or temperature using an intermediate fluid to the sensor.

In particular embodiments, transducers, such as capacitive transducers, are mounted near the top of the resonant cavity as an electrical element of the sensor sleeve. Remote parameters can be brought to the sensor in the resonant cavity via a conduit that passes through and into a sealed sensing unit. The measurement of a desired parameter can then be remotely monitored. The monitoring can further be extended using a mechanical mechanism from the sensor to relocate the sensor within the resonant cavity at different locations along the length of the conductive pipe 102. In FIG. 4, a sensor conduit 404 is provided to a pressure or temperature zone to be monitored.

Figure 6:
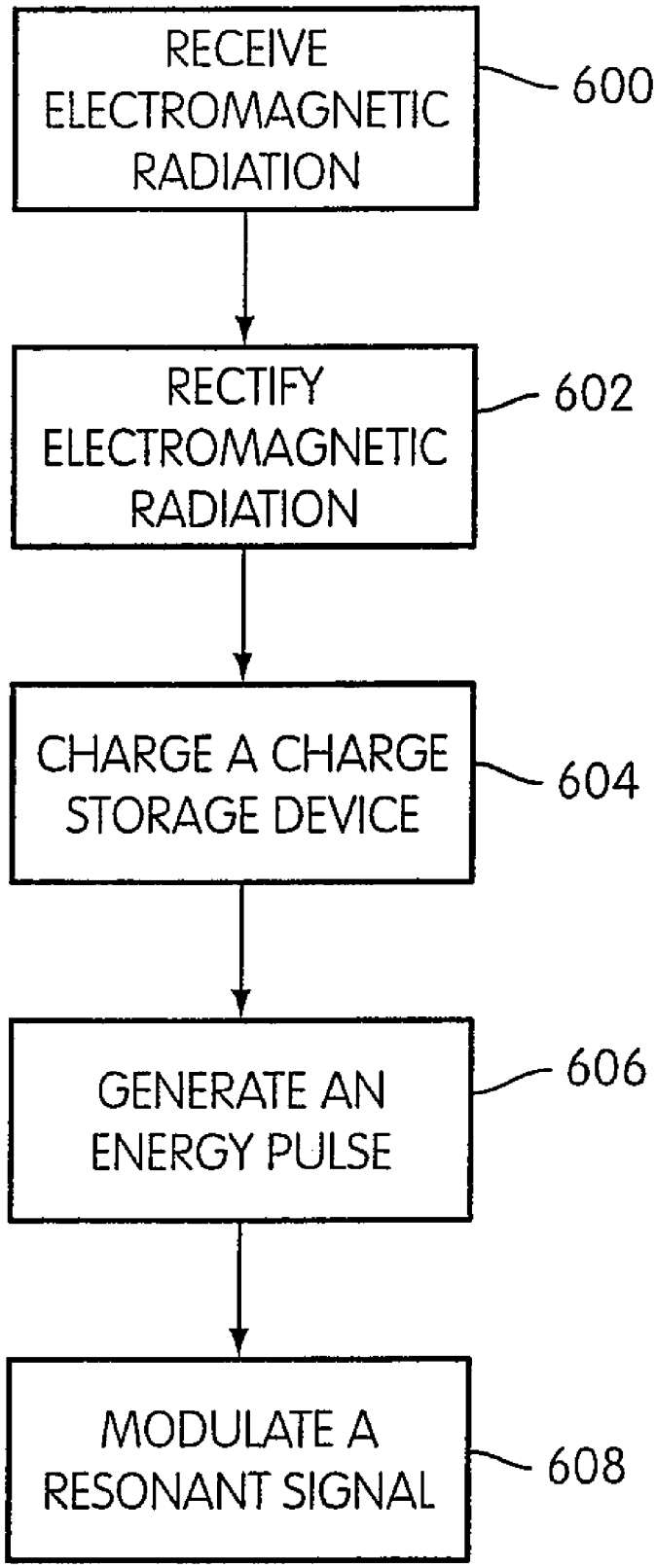
FIG. 6 schematically illustrates an embodiment of a method for sensing a characteristic of a borehole.

FIG. 6 is a block diagram of a method of telemetry data gathering using the apparatus 100, the sequence of which will be explained with reference to the embodiment of the pulse generator 109 illustrated in FIG. 7. At 600, electromagnetic energy, for example in the form of radio frequency radiation, is received by the pulse generator 109. In an example, the electromagnetic energy may be input at a frequency of 300 kHz, however, those of ordinary skill in the art will appreciate that a wide range of frequencies may be used.

Figure 7:
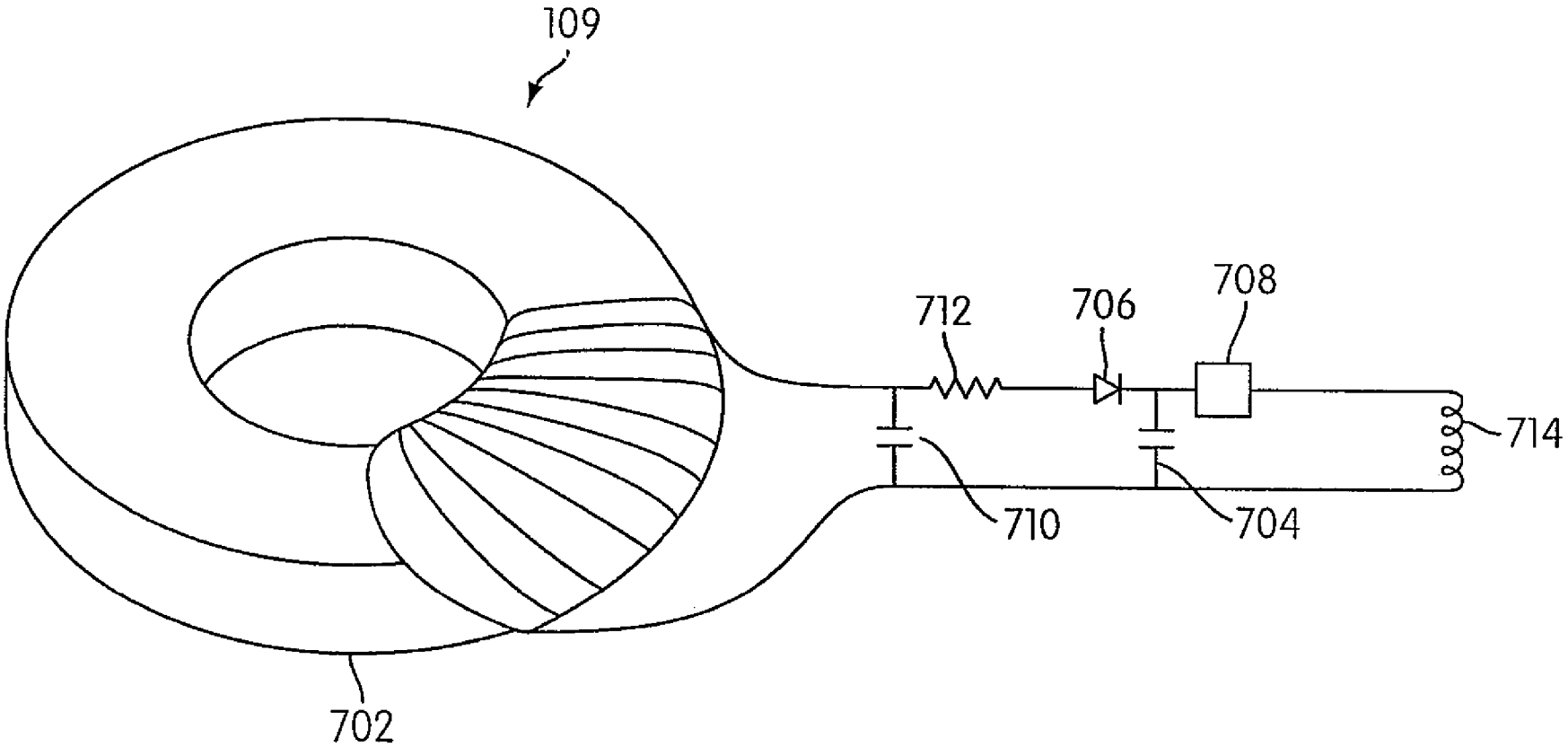
FIG. 7 is an example of a pulse generator in accordance with embodiments of the present invention.

As illustrated in FIG. 7, a multi-wound inductor 702 based on a low frequency ferrite core accepts the input energy from the electromagnetic energy, and produces a current within the components of the pulse generator 109. Optionally, the current is rectified 602 using rectifier 112 (schematically illustrated in FIG. 5).

At 604, the energy is used to charge a storage device, which in FIG. 7 is a capacitor 704. Those skilled in the art will appreciate that the electrical energy storage device may be a capacitor, battery, or other suitable storage device, and the rectifier may be a diode (e.g., diode 706 as shown in FIG. 7).

Upon sufficient charging (i.e., upon reaching a threshold, which may be a charge threshold or a voltage threshold, for example) of the energy storage device, an energy pulse is generated (606) between the electrodes (not illustrated) in the spark gap 708. By way of example, for an electrode pair separated by a dielectric (e.g., air or an inert gas), upon reaching the dielectric breakdown voltage, the spark is generated.

Generation of the spark creates an electromagnetic pulse, energy from which is received by the resonant cavity or cavities 120. The resonant cavity or cavities modulate a resonant signal (608) as described above. The modulated signal has an intensity determined by the intensity of the energy pulse and frequency components determined in part by the characteristics of the borehole that are under interrogation.

In the example illustrated in FIG. 7, the pulse generator 109 also includes a low frequency capacitor 710 that can be selected to set the resonation of the core winding of the core 702 to a low drive frequency (e.g., on the order of 1/20-1/30 the frequency of the frequencies of the resonant cavities 120), providing for large voltage gain in the generator 109. Resistor 712 is a timing resistor that serves to set the timing of the charging of the storage capacitor 704. Finally, a single turn coil 714 may be looped through the cores of the resonators 120 in order to couple the electromagnetic energy of the pulse generator 109 into the resonators 120.

In accordance with embodiments, energy can be sent wirelessly to the down-hole telemetry/interrogation device and stored. The energy can be periodically released by the spark gap in a highly energetic form thus enhancing the signal to be received above ground.

The signal can be energetic enough that either the pipe structure of the well or separate antennas located away from the well site can be used as receiving antennas. Transmission can thus also occur through the ground itself.

The data bandwidth can be of much higher frequency than mud pulsing methods. In addition to transmission of data, such as down-hole temperature and pressure, the signal can be used to interrogate the structure of the local formations. In the through-ground mode, the formation structures underground cause frequency shifts and attenuations and other phenomenon that can be interpreted and thus indicate the nature of the underground structures.

Circuits used by the wireless system can be quite robust and can be made to withstand the high temperatures and pressures of down-hole conditions. For example, a single semiconductor device, (e.g., diode 708 of FIG. 7), can be used for power rectification. Power diodes may be selected to be sufficiently rugged to withstand typical conditions downhole.

Those skilled in the art will appreciate that the disclosed embodiments described herein are by way of example only, and that numerous variations will exist. The invention is limited only by the claims, which encompass the embodiments described herein as well as variants apparent to those skilled in the art.

The invention claimed is:

1. An apparatus for sensing a characteristic of a borehole, comprising:

a transmission line, constructed and arranged to transmit an electromagnetic signal within the borehole; and a probe, positionable at a location within the borehole at which the borehole characteristic is to be sensed, and at which energy propagated via the transmission line is to be received, the probe comprising:

an energy storing circuit element, configured to receive and store energy transmitted through the transmission line;

a pulse generator, configured to receive stored energy from the energy storing circuit element and to discharge the energy to generate a pulse of electromagnetic energy; and a resonant circuit portion that is configured and arranged to receive energy from the pulse of electromagnetic energy and produce a modulated electromagnetic signal representative of the borehole characteristic and to transmit a signal representative of the modulated electromagnetic signal via the transmission line.

2. The apparatus as in claim 1, wherein the pulse generator comprises a spark generator having electrodes separated by a gap, the spark generator being further configured and arranged such that when a voltage across the gap exceeds a breakdown voltage of a medium in which the probe is located, a spark discharge between the electrodes generates the electromagnetic pulse.

3. The apparatus as in claim 1, wherein the transmission line comprises a coaxial transmission line.

4. The apparatus as in claim 3, wherein the coaxial transmission line includes a central conductor and an outer conductor and wherein the central conductor comprises a conductive pipe and the outer conductor comprises a conductive casing of the borehole.

5. The apparatus as in claim 1, wherein the transmitted signal representative of the modulated electromagnetic signal comprises a radio frequency signal.

6. An apparatus for sensing a characteristic of a borehole, the apparatus being positionable at a location within the borehole at which the borehole characteristic is to be sensed, and at which electromagnetic energy propagated along the borehole is to be received, comprising:

an energy storing circuit element, configured to receive and store the electromagnetic energy;

a pulse generator, configured to receive stored energy from the energy storing circuit element and to discharge the energy to generate a pulse of electromagnetic energy;

a resonant circuit portion that is configured and arranged to receive energy from the pulse of electromagnetic energy and produce for analysis a modulated electromagnetic signal representative of the borehole characteristic.

7. The apparatus as in claim 6, wherein the pulse generator comprises a spark generator having electrodes separated by a gap, the spark generator being further configured and arranged such that when a voltage across the gap exceeds a breakdown voltage of a medium in which the probe is located, a spark discharge between the electrodes generates the electromagnetic pulse.

8. The apparatus as in claim 6, wherein the modulated electromagnetic signal representative of the borehole characteristic comprises an electromagnetic signal for transmission via a transmission line.

9. The apparatus as in claim 6, wherein the modulated electromagnetic signal representative of the borehole characteristic comprises an electromagnetic signal for wireless transmission.

10. The apparatus as in claim 9, wherein the signal for wireless transmission comprises a wireless radio frequency electromagnetic radiation signal.

11. A method for sensing a characteristic of a borehole, comprising:

receiving electromagnetic energy proximate a location within the borehole at which the borehole characteristic is to be sensed;

storing the received electromagnetic energy, then discharging the stored energy to generate an electromagnetic pulse within the borehole;

receiving energy from the electromagnetic pulse in a resonant circuit to produce an electrical signal in the resonant circuit;

modulating the electrical signal to produce a modulated electromagnetic signal representative of the borehole characteristic; and transmitting the modulated electromagnetic signal for analysis.

12. The method as in claim 11, wherein the discharging comprises initiating a spark across a gap between electrodes to generate the electromagnetic pulse.

13. The method as in claim 11, further comprising:

receiving the transmitted signal; and analyzing the signal to determine information about the borehole characteristic.

14. The method as in claim 13, wherein the analyzing comprises performing a Fourier analysis.

15. The method as in claim 13, wherein the analyzing is performed by a processor and comprises using a computer readable look-up table of correspondences between the borehole characteristic and modulation frequencies.

16. The method as in claim 11, wherein the modulating is performed by a change in a characteristic of a circuit element of a resonant circuit.

17. The method as in claim 16, wherein the change comprises a change in capacitance of a capacitive sensor.

18. The method as in claim 16, wherein the change comprises a change in inductance of an inductive sensor.

19. The method as in claim 11, wherein the transmitting comprises transmitting via a transmission line.

20. The method as in claim 11, wherein the transmitting comprises transmitting wirelessly.

21. The method as in claim 20, further comprising:

receiving the transmitted signal after it has passed through at least a portion of a geological formation proximate the borehole; and analyzing modulations of the transmitted signal imposed thereon by its passing through the geological formation.

22. A system for monitoring a characteristic of a borehole, the system comprising:

a transmitter configured and arranged to transmit an electromagnetic signal into the borehole;

a transmission line constructed and arranged to guide propagation of the electromagnetic signal within the borehole;

a probe, positionable at a location within the borehole at which the borehole characteristic is to be sensed, and at which energy propagated via the transmission line is to be received, the probe comprising:

an energy storing circuit element, configured to receive and store energy transmitted through the transmission line;

a spark generator, configured to receive stored energy from the energy storing circuit element and having electrodes separated by a gap, the spark generator being further configured and arranged such that when a voltage across the gap exceeds a breakdown voltage of a medium in which the probe is located, a spark discharge between the electrodes generates an electromagnetic pulse;

a resonant circuit portion that is configured and arranged to receive energy from the electromagnetic pulse and produce a modulated electromagnetic signal representative of the borehole characteristic and to transmit a radio frequency signal representative of the modulated electromagnetic signal via the transmission line;

a receiver, configured and arranged to receive the radio frequency signal representative of the modulated electromagnetic signal and to output an electrical signal representative of the received radio frequency signal; and a processor, configured and arranged to accept as an input the electrical signal output by the receiver and to process the received electrical signal to determine information relating to the monitored characteristic.

* * * * *